United States Patent [19]

Schieler

[11] Patent Number: 4,668,245

[45] Date of Patent: May 26, 1987

[54] FUEL ADDITIVE FOR USE IN ALCOHOL FUELS

[75] Inventor: Leroy Schieler, Auburn, Calif.

[73] Assignee: BankAmerica Corporation, San Francisco, Calif.

[21] Appl. No.: 921,860

[22] Filed: Oct. 22, 1986

[51] Int. Cl.[4] ..... C10L 1/02

[52] U.S. Cl. ..... 44/53; 44/56; 44/71; 252/392

[58] Field of Search ..... 44/56, 53, 71; 252/392

[56] References Cited

U.S. PATENT DOCUMENTS

| | | | |
|---|---|---|---|
| 4,275,835 | 6/1981 | Miksic | 239/60 |
| 4,376,635 | 3/1983 | Sung | 44/56 |
| 4,384,872 | 5/1983 | Kester et al. | 44/56 |
| 4,392,868 | 7/1983 | Techmeyer et al. | 44/56 |
| 4,412,845 | 11/1983 | Kaufman et al. | 44/53 |
| 4,419,105 | 12/1983 | Sung | 44/71 |
| 4,428,754 | 1/1984 | Smith | 44/56 |
| 4,445,907 | 5/1984 | Sung | 44/53 |
| 4,459,132 | 7/1984 | Kaufman | 44/56 |

FOREIGN PATENT DOCUMENTS

| | | |
|---|---|---|
| 0086049 | 8/1983 | European Pat. Off. . |
| 821218 | 10/1959 | United Kingdom . |
| 1287433 | 8/1972 | United Kingdom . |

OTHER PUBLICATIONS

Chemical Abstracts, 55–Ferrous Metals, vol. 97, 1982, 97:167300n.
Chemical Abstracts, vol. 95, 1981, 95:137005m.
Chemical Abstracts, vol. 95, 1981, 95:172398p.
Chemical Abstracts, vol. 95, 1981, 95:172399q.
Chemical Abstracts, vol. 98, 1983, 98:182465j.
Chemical Abstracts, vol. 99, 1983, 99:38234m.
Chemical Abstracts, vol. 99, 1983, 99:75444a.
Chemical Abstracts, 51–Fossil Fuels, vol. 99, 1983, 99:142897r.
Chemical Abstracts, vol. 97, 1982, 97:91967n.
Chemical Abstracts, 25–Benzenes, vol. 99, 1983, 99:212295u.

*Primary Examiner*—William R. Dixon, Jr.
*Assistant Examiner*—Margaret B. Medley
*Attorney, Agent, or Firm*—Flehr, Hohbach, Test, Albritton and Herbert

[57] ABSTRACT

The present invention provides a method for inhibiting corrosion and elastomer swelling and degradation caused by alcohol and alcohol-containing fuels and for increasing lubricity of alcohol or alcohol-containing fuels, comprising the step of adding to alcohol or alcohol-containing fuels, a fuel additive comprising one or more reaction products of a carboxylic acid or acid chloride selected from the group consisting of unsubstituted aromatic carboxylic acids, aliphatic carboxylic acids, nitro-substituted aromatic carboxylic acids and their corresponding acid chlorides, and an amine selected from the group consisting of aliphatic amines, cycloaliphatic amines, and aromatic amines. The present invention also provides a fuel composition for internal combustion engines, comprising: (a) a major portion of fuel comprising from about 1 to 100% by volume of an alcohol having 1 to 4 carbon atoms and from about 99 to 0% by volume of a non-alcohol fuel selected from the group consisting of gasoline, individual hydrocarbon components of gasoline, and dimethoxymethane, and (b) a minor portion of the fuel additive described above.

33 Claims, No Drawings

FUEL ADDITIVE FOR USE IN ALCOHOL FUELS

The present invention is directed to a method for inhibiting corrosion and elastomer swelling and degradation caused by alcohol or alcohol-containing fuels, and for increasing lubricity of alcohol or alcohol-containing fuels. The present invention is also directed to alcohol and alcohol-containing fuel compositions containing said fuel additive and characterized by improved corrosion inhibition, elastomer-swelling and degradation inhibition, and increased lubricity.

Alcohol fuels and alcohol-containing fuels, such as alcohol-gasoline fuel blends, possess a much higher degree of corrosive activity than non-alcohol fuels, such as gasoline, the individual hydrocarbon components of gasoline, and dimethoxymethane (commonly known as methylal). The high corrosive activity is generally attributed to the presence of acidic and halogen ion containing contaminants present in alcohols but not present in the non-alcohol fuels identified above.

The metal alloys protective coatings and elastomers used in constructing automotive components and gasoline fuel dispensing systems have traditionally been selected and developed specifically for chemical compatibility with gasoline and the individual hydrocarbon components of gasoline. The contaminants present in alcohols are particularly destructive to various non-ferrous metals and metal coatings, such as lead-tin alloys (i.e., lead-terneplate alloys) used to coat the internal surfaces of steel fuel tanks and fuel lines, and to zinc or aluminum alloys used in carburetor construction. As a result, motor vehicles using alcohol or alcohol-containing fuels have shown a greater propensity toward corrosion in the fuel tank, fuel line and fuel dispensing system areas.

The corrosive failure of the metal alloys and protective coatings used in constructing the automotive components increases proportionately to the percentage increase of alcohol in the fuel. Thus, some corrosion protection is required whenever alcohol or alcohol-containing fuels are used in an internal combustion engine. The relative corrosivity of the alcohols is inversely proportional to their polarities expressed in units of dielectric constant. The dielectric constant of alcohols having 1 to 4 carbon atoms, gasoline and dimethoxymethane are shown in TABLE 1.

TABLE 1

DIELECTRIC CONSTANT OF ALCOHOLS AND GASOLINE

| ALCOHOL | DIELECTRIC CONSTANT, $\epsilon$ at 25° C. |
|---|---|
| methanol | 32.6 |
| ethanol | 24.3 |
| n-propanol | 20.1 |
| iso-propanol | 18.3 |
| n-butanol | 17.8 |
| iso-butanol | 17.7 |
| tert-butanol | 17.0 |
| sec-butanol | 10.9 |
| dimethoxymethane | 10.0 |
| gasoline | 2.0 |

The quantity and efficiency of a corrosion inhibitor necessary to provide adequate protection to the metal alloy automotive parts is directly proportional to the amount of alcohol in the fuel and inversely proportional to the polarity of the alcohol expressed in units of dielectric constant.

Because the alcohols in Table 1 are more polar than gasoline, many of the elastomers traditionally used to construct automotive components in internal combustion engines are not chemically compatible with alcohol fuels or alcohol-containing fuels containing larger amounts of alcohol. The degree of elastomer swelling and degradation is directly proportional to the alcohol's polarity expressed in units of dielectric strength in Table 1. In general, alcohols with higher polarity or dielectric strengths are good solvents for the elastomers and cause attendant elastomer swelling and degradation. Because methanol has the highest polarity of the alcohols in Table 1, methanol or methanol-containing fuels are the least compatible with the elastomers normally present in a gasoline burning internal combustion engine.

Some common elastomer failures are caused by the swelling of the elastomer known as Viton TM used in critical carburetor components, the hardening and cracking of the elastomer known as Buna-N TM used in fuel pump diaphragms, the hardening of neoprene-coated diaphragms, the shrinking of cork gaskets, the disintegration of polyurethane components, the hardening of vinyl fuel hoses, and the delamination of polyester-laminated fiberglass used in some vehicle fuel tanks and many underground fuel storage tanks.

Alcohol fuels and alcohol-containing fuels, particularly methanol fuels, are "dry" fuels and do not display the oiliness characteristic of gasoline. As a consequence metal-to-metal wear in alcohol fuels or alcohol-containing fuels is significantly greater than in gasoline fuels. To counteract this deficiency, alcohol fuels and particularly methanol fuels should contain a lubricity additive. Alcohol-gasoline blends containing low alcohol contents usually do not require lubricity additives. However, as the alcohol content of the fuel increases, the need for additional lubricity protection increases. This is particularly true during cold weather and Arctic operating conditions.

Some known corrosion inhibitors for use in alcohol or alcohol-containing hydrocarbon fuels have been disclosed in U.S. Pat. Nos. 4,282,007, 4,282,008, and 4,376,635, and in European Patent Application No. 0086049. U.S. Pat. No. 4,282,007 discloses an anti-corrosion fuel additive comprising the reaction product of aminotriazoles and polyisobutenyl succinic acid anhydride. U.S. Pat. No. 4,282,008 discloses an anti-corrosion fuel additive comprising the reaction products of aminotriazole, isatoic anhydride and N-alkylpropylene diamine. U.S. Pat. No. 4,376,635 discloses an anti-corrosion fuel additive comprising a reaction product of a benzotriazole, an aldehyde or a ketone, and a $C_3$–$C_{12}$ poly-primary amine bearing at least one free —$NH_2$ group and at least one NHR′ group wherein R′ is a $C_{12}$–$C_{18}$ hydrocarbon group.

European Patent Application No. 0086049 discloses a corrosion inhibiting fuel additive comprising a reaction product of at least one succinic acylating agent selected from the group consisting of unsubstituted and aliphatic hydrocarbon based substituted succinic acylating agents, and at least one amine of the formula

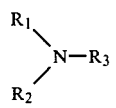

wherein $R_1$ is a hydrocarbon based radical and $R_2$ and $R_3$ are independently hydrogen or hydrocarbon based radicals with the proviso that when $R_2$ and $R_3$ are both hydrogen, $R_1$ is a hydrocarbon based radical selected from the group consisting of tertiaryalkyl, cycloyalkyl, aryl, alkaryl and aralkyl radicals.

It is an object of the present invention to provide a method for inhibiting corrosion of metals and metal coatings and the swelling and degradation of elastomers in an internal combustion engine caused by alcohol or alcohol-containing fuels and for increasing the lubricity of alcohol or alcohol-containing fuels.

It is another object of the present invention to provide an alcohol or alcohol-containing fuel composition containing said fuel additive and characterized by corrosion inhibition, elastomer swelling and degradation inhibition, and increased lubricity.

It is another object of the present invention to provide a method for inhibiting corrosion and elastomer swelling and degradation caused by alcohol or alcohol-containing fuels and for increasing lubricity of alcohol or alcohol-containing fuels, such that the alcohol or alcohol-containing fuel will be compatible with the materials of construction commonly used in the petrochemical industry for tankers, pipelines, metal and fiberglass storage tanks, service station storage tanks, fuel lines and fuel pumps.

In general, the present invention provides a method for inhibiting corrosion and elastomer swelling and degradation caused by alcohol or alcohol-containing fuels and for increasing lubricity of alcohol or alcohol-containing fuels, comprising the step of adding to alcohol or alcohol-containing fuels a fuel additive comprising: a reaction product of (a) a carboxylic acid or acid chloride selected from the group consisting of unsubstituted aromatic carboxylic acids, aliphatic carboxylic acids, nitro-substituted aromatic carboxylic acids, and their corresponding acid chlorides; and (b) an amine selected from the group consisting of aliphatic amines, cycloaliphatic amines and aromatic amines. Preferred carboxylic acids or their corresponding acid chlorides are nitro-substituted aromatic carboxylic acids or acid chlorides. Preferred amines are aliphatic amines. The most preferred reaction product is meta-nitrobenzoctadecylamide.

The present invention also provides a fuel composition for use in internal combustion engines comprising (a) a major portion of a fuel comprising from about 1 to 100% by volume of an alcohol having 1 to 4 carbon atoms and from about 99 to 0% by volume of gasoline, individual hydrocarbon gasoline components, or dimethoxymethane, and (b) a minor portion of the fuel additive generally described above.

The fuel additive comprising one aspect of this invention are prepared by the reaction of a carboxylic acid or acid chloride selected from the group consisting of unsubstituted aromatic carboxylic acids, aliphatic carboxylic acids, nitro-substituted aromatic carboxylic acids and their corresponding acid chlorides, and an amine selected from the group consisting of aliphatic amines, cycloaliphatic amines, and aromatic amines to form an amide as shown in equations 1 and 2 below.

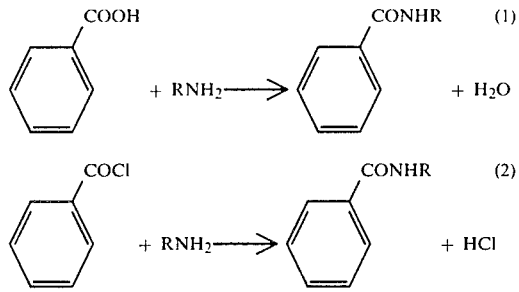

Preferred unsubstituted aromatic carboxylic acids or acid chlorides are benzoic acid, ortho-toluic acid, para-toluic acid, phthalic acid and their corresponding acid chlorides. Preferred aliphatic carboxylic acids or acid chlorides are aliphatic carboxylic acids having more than 12 and less than 30 carbon atoms and their corresponding acid chlorides. A more preferred aliphatic carboxylic acid or acid chloride is octadecylcarboxylic acid or acid chloride.

Preferred nitro-substituted aromatic carboxylic acids or acid chlorides are ortho-nitrobenzoic acid, metanitrobenzoic acid, para-nitrobenzoic acid, ortho-,para-dinitrophenyl acetic acid, 3,5,6-trinitro-salicylic, and their corresponding acid chlorides. More preferred nitro-substituted carboxylic acids or acid chlorides are ortho-nitrobenzoic acid, meta-nitrobenzoic acid, para-nitrobenzoic acid, and their corresponding acid chlorides. The most preferred nitro-substituted carboxylic acid or acid chloride is meta-nitrobenzoic acid or acid chloride.

The amine reactant is selected from the group consisting of aliphatic amines, cycloaliphatic amines and aromatic amines. Preferred aliphatic, cycloaliphatic, and aromatic amines include, $C_{10}$–$C_{30}$ aliphatic amines, cyclohexyl amine, methylcyclohexyl amine, aniline, o-toluidine, m-toluidine, p-toluidine, 2,4-xylidine, 2,5-xylidine, 2,6-xylidine, 3,4-xylidine and 3,5-xylidine. A preferred amine is an aliphatic amine having more than 12 and less than 30 carbon atoms. The most preferred amine is octadecylamine.

The additive composition of the present invention may be prepared by heating mixtures of the carboxylic acid or acid chloride with the amine at temperatures ranging from about 15° C. to about 100° C. A preferred range of temperatures is from about 15° C. to about 50° C. for carboxylic acid chlorides and 60° C. to 100° C. for carboxylic acids.

The proportions of the reactants are not critical. However, it is preferred that the molar ratio of the carboxylic acid or acid chloride to the amine range from about 1.05/1.0 to about 1.30/1.0. A more preferred molar ratio is 1.1/1.0.

An organic solvent may be used to provide a homogenous mixture for the reaction of the amine with the carboxylic acid or acid chloride. Almost any common organic solvent can be used, including alcohols, benzene, acetone, methylethyl ketone, diethyl ether, dioxane, aliphatic hydrocarbons having 6 to 10 carbon atoms, and cyclohexane. Preferred solvents are methanol and ethanol. The optimum choice for any particular reaction depends on the physical and chemical properties of the reactants.

A preferred reaction product is an amide with a carboxylic acid component having a dielectric constant higher than that of the alcohol in the fuel and an aliphatic amine component having a chain length of more than 12 and less than 30 carbon atoms. Preferred reaction products are nitro-benzoctadecylamide, benzoctadecylamide, and dioctadecylamide. The latter two reaction products are suitable for use with methanol-gasoline fuel blends containing 15 percent or less methanol, any alcohol-gasoline fuel blend containing the higher alcohols (ethanol, propanol, butanol and isomers thereof), or any alcohol-dimethoxymethane fuel blend. Nitrobenzoctadecylamide is suitable for use with any alcohol fuel or alcohol-containing fuel blend described herein. The most preferred reaction product is meta-nitrobenzctadecylamide, also known as 1-nitro-3-hexadecylamide, 3-nitrobenzoctadecylamide, and 1-octadecylamide-3-nitrobenzene.

The fuel additive of the fuel invention may also comprise a mixture of two or more of the reaction products of (a) a carboxylic acid or acid chloride selected from the group consisting of unsubstituted aromatic carboxylic acids, aliphatic carboxylic acids, nitro-substituted aromatic carboxylic acids, and their corresponding acid chlorides, and (b) an amine selected from the group consisting of aliphatic amines, cycloaliphatic amines, and aromatic amines. The fuel additive of the present invention may comprise a mixture of two or more of any reaction product described herein or of any reaction product formed by the reaction of any carboxylic acid or acid chloride and any amine described herein. Preferably, the fuel additive of the present invention may comprise a mixture of two or more of the following preferred reaction products: nitro-benzoctadecylamide, benzoctadecylamide and dioctadecylamide.

The method of the present invention comprises the step of adding the fuel additive described above to alcohol or alcohol-containing fuels to inhibit corrosion and elastomer swelling and degradation in internal combustion engines and in fuel dispensing systems caused by alcohol or alcohol-containing fuels and to increase the lubricity of alcohol or alcohol-containing fuels.

The fuel compositions of the present invention comprise: (a) a major portion of a fuel comprising from about 1 to 100% by volume of an alcohol having 1 to 4 carbon atoms and from about 99 to 0% by volume of a non-alcohol fuel selected from gasoline, individual hydrocarbon components of gasoline, and dimethoxymethane (hereinafter methylal), and (b) a minor portion of the fuel additive of the present invention as described above.

Alcohols useful in combination with the additive of the present invention described herein include such commercially available alcohols as methanol, ethanol, n-propanol, iso-propanol, n-butanol, sec-butanol, iso-butanol and tertiary-butanol. Preferred alcohols are methanol and ethanol and the most preferred alcohol is methanol. Mixtures of the various alcohols may be used. In methanol-gasoline blends, it is often necessary to include other alcohols to provide adequate protection against phase separation under high humidity and cold weather conditions.

Non-alcohol fuels useful in combination with the alcohols and the additive of the present invention include gasoline, individual hydrocarbon components of gasoline, and methylal. The preferred non-alcohol fuel is gasoline.

In a preferred embodiment, the fuel portion of the fuel composition comprises from about 1 to 50% by volume of at least one alcohol having 1 to 4 carbon atoms and from about 99 to 50% by volume of a non-alcohol fuel selected from the group identified above. In a more preferred embodiment, the fuel portion comprises about 3 to 20% by volume of the alcohol and about 97 to 80% by volume of a non-alcohol fuel identified above.

The preferred alcohol is methanol and the preferred non-alcohol fuel is gasoline. A preferred fuel composition comprises from about 1 to 100% by volume methanol and from about 99 to 0% by volume gasoline. A more preferred fuel composition comprises from about 1 to 50% by volume methanol and about 99 to 50% by volume gasoline. The most preferred fuel composition comprises from about 3 to 20% by volume methanol and from about 97 to 80% by volume gasoline.

The amount of the fuel additive of the present invention to be added to the fuel portion to provide the fuel composition of the present invention will be an amount sufficient to impart improved corrosion-inhibiting, elastomer swelling and degradation inhibiting, and increased lubricity characteristics to the fuel compositions. Preferably, the amount of additive in the fuel composition will be in the range of from about 0.1 to 5.0% by weight. More preferably, the additive will be present in the fuel composition in the range of from about 0.1 to 1.0% by weight. Most preferably, 0.15% by weight of the additive of the present invention will be present in the fuel composition.

The fuel compositions of the present invention can be prepared by adding the reaction product of the nitro-substituted aromatic carboxylic acid and the amine directly to the alcohol fuel portion or the alcohol-containing fuel portion.

The fuel additive of the present invention is an effective corrosion inhibitor for alcohol fuels and alcohol-containing fuels. It is equally effective in providing corrosion protection against both acidic and alkaline contaminants. Common sources of acidic contaminants are tanker trucks, acidic soils and fuel combustion products. Common sources of alkaline contaminants are tanker trucks, alkaline soils and alkaline detergents used in automotive cleaning facilities.

Each molecule of the fuel additive of the present invention can neutralize one molecule of acid or one molecule of base thereby providing corrosion protection. Equations 3 and 4 illustrate the reactions wherein the fuel additive of the present invention neutralizes hydrochloric acid (an acidic contaminant) and sodium hydroxide (an alkaline contaminant).

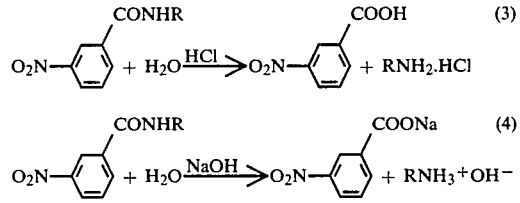

(3)

(4)

The corrosion reaction product of the acidic reaction, $RNH_2.HCl$, can in turn neutralize an alkaline contaminant, if present, as illustrated in Equation 5.

$$RNH_2.HCl + NaOH \rightarrow RNH_2 + NaCl \quad (5)$$

This is a cyclical process in which the amine is regenerated and is then available for neutralization of another acid molecule. This cyclical process can be repeated indefinitely until the relative amounts of acidic and alkaline contaminants introduced into the system have been substantially depleted.

The corrosion reaction product from the basic reaction, the amine salt $RNH_2^+OH^-$, can in turn neutralize an acidic contaminant, if present, and regenerate the amine which is then available for neutralization of another molecule of acidic contaminant, as illustrated in Equation 6.

$$RNH_3^+OH^- + HCl \rightarrow RNH_2.HCl + H_2O \quad (6)$$

The fuel additive of the present invention effectively inhibits the swelling and degradation of hydrocarbon polymers or elastomers caused by alcohol fuels. Retention of original dimensions through long periods of service is an essential requirement for elastomer automotive components. Hydrocarbon polymers or elastomers used to construct parts for internal combustion engines are commonly selected for their compatability with gasoline and have a polarity approximately equal to the polarity of gasoline (dielectric constant of gasoline=2 at 25° C.). Alcohols having 1 to 4 carbon atoms have a much higher polarity than gasoline, particularly methanol which has a dielectric constant of 32 at 25° C. The swelling and degradation of hydrocarbon polymers or elastomers selected for use with gasoline fuels is due to the large difference in polarity between the alcohol and the elastomer.

While not intending to limit the invention by a particular theory, it is believed that the additive of the present invention inhibits elastomer swelling and degradation by forming a protective layer adjacent to the elastomer surface. The carboxylic acid component of the additive is more polar than the alcohols having 1 to 4 carbons and thus, will displace the alcohol from the surface of the elastomer and attach itself to the elastomer surface. For instance, the nitrobenzoic acid component of a preferred additive, meta-nitrobenzoctadecylamide, has a dielectric constant of 40 at 25° C., whereas methanol has a dielectric constant of 32 at 25° C. Since the nitro-substituted aromatic carboxylic acid component is more polar than the methanol or other alcohols, it will displace the methanol or alcohol from the surface of the elastomer and form a protective layer. The amine component of the additive, which has a dielectric constant closer to that of gasoline, extends outward from the carboxylic acid component anchored to the elastomer surface, thus providing a polar environment adjacent to the elastomer surface similar to that of gasoline. For instance, an aliphatic amine having more than 12 and less than 30 carbon atoms has a dielectric constant from about 2 to 5 at 25° C., whereas gasoline has a dielectric constant of 2 at 25° C. The amine component provides a protective barrier against re-entry of the alcohol and thus inhibits the swelling and chemical degradation of elastomers caused by alcohols.

The additive of the present invention also increases the lubricity of the fuel composition. The fuel additive of the present invention provides lubricity properties via the amine component. Preferably, for optimum lubricity properties, the amine will be an aliphatic amine having 10 to 30 carbon atoms. The most preferred aliphatic amine has 18 carbon atoms. The long chain aliphatic amine ensures that the acidic contaminants or combustion products which are neutralized by the additive of the present invention will be in the liquid state. The long chain aliphatic amine also ensures that any blowby products which enter the crank case will be soluble in the lubricating oil.

EXAMPLE 1

A test was performed to determine whether the additive of the present invention would alleviate the elastomer swelling encountered when operating vehicles on methanol-gasoline blends of more than 8%. The control data was obtained from a 1980 Chevrolet Citation TM which had been driven 349 miles on a 5% methanol-95% gasoline fuel blend. The carburetor was then disassembled and inspected, and measurements of elastomer components in the carburetor were taken. See column 1 of CHART 1 below.

The same vehicle was then driven for 2979 miles on a 10% methanol-90% unleaded gasoline fuel blend containing meta-nitrobenzoctadecylamide. 225 ml. of the additive was added to 30 gallons of the 10% methanol-90% unleaded gasoline fuel blend. The only difference in drivability noted was an increase in warm-up time. The carburetor was disassembled and inspected, and measurements of the elastomer components in the carburetor were taken. See column 2 of CHART 1 below.

CHART 1
CARBURETOR MEASUREMENTS

| Carburetor Components | 1 | 2 |
|---|---|---|
| Accelerator Pump Cup | 0.650 units | 0.650 units |
| Float Needle | 0.164 units | 0.164 units |
| Mixture Control Solenoid O-Ring | 0.332 units | 0.332 units |
| Float Weight | 8.3 grams | 8.3 grams |
| Float Level (Dry) | 0.250 units | 0.250 units |

The inspection of the carburetor elastomers demonstrated that no swelling had occurred and that all items measured before and after the vehicle was driven on the 10% methanol fuel blend remained the same size. No foreign material was found in the fuel filter or the carburetor bowl. The mixture control solenoid O-ring appeared to soften slightly. The Citation TM achieved 19.4 miles per gallon when operated on the 5% methanol blend for 349 miles and 20.5 miles per gallon when operated on the 10% methanol fuel blend with meta-nitrobenzoctadecylamide.

What is claimed is:

1. A method for inhibiting corrosion and elastomer swelling and degradation caused by alcohol and alcohol-containing fuels and for increasing lubricity of alcohol and alcohol-containing fuels, comprising the step of adding to alcohol and alcohol-containing fuels a fuel additive comprising a reaction product of a nitro-substituted aromatic carboxylic acid or acid chloride and an amine selected from the group consisting of aliphatic amines, cycloaliphatic amines, and aromatic amines, said reaction product being formed by reacting said carboxylic acid or acid chloride and said amine at a temperature in the range of about 15°–100° C. in a molar ratio in the range of about 1.05/1.10 to about 1.30/1.0 carboxylic acid or acid chloride to amine.

2. A method according to claim 1, wherein said reaction product is nitrobenzoctadecylamide.

3. A method for inhibiting corrosion and elastomer swelling and degradation caused by alcohol and alcohol-containing fuels and for increasing lubricity of alcohol and alcohol-containing fuels, comprising the step of adding to alcohol and alcohol-containing fuels a fuel additive comprising a mixture of two or more reaction products obtained from a reaction of a nitro-substituted aromatic carboxylic acid or acid chloride, and an amine selected from the group consisting of aliphatic amines, cycloaliphatic amines, and aromatic amines, said reaction products being formed by reacting said carboxylic acid or acid chloride and said amine at a temperature in the range of about 15°-100° C. in a molar ratio in the range of about 1.05/1.10 to about 1.30/1.0 carboxylic acid or acid chloride to amine.

4. A method according to claim 1 or 3, wherein said nitro-substituted aromatic carboxylic acid or acid chloride is selected from the group consisting of ortho-nitrobenzoic acid or acid chloride, meta-nitrobenzoic acid or acid chloride, para-nitrobenzoic acid or acid chloride, ortho-, para-dinitrophenyl acetic acid or acid chloride, and 3,5,6-trinitro-salicylic acid or acid chloride.

5. A method according to claim 4, wherein said nitro-substituted aromatic carboxylic acid or acid chloride is selected from ortho-nitrobenzoic acid or acid chloride, meta-nitrobenzoic acid or acid chloride, and para-nitrobenzoic acid or acid chloride.

6. A method according to claim 5, wherein said nitro-substituted aromatic carboxylic acid or acid chloride is meta-nitrobenzoic acid or acid chloride.

7. A method according to claim 1 or 3, wherein said amine is selected from the group consisting of aliphatic amines having 10 to 30 carbon atoms, cyclohexyl amine, methylcyclohexyl amine, aniline, orthotoluidine, meta-toluidine, para-toluidine, 2,4-xylidine, 2,5-xylidine, 2,6-xylidine, 3,4-xylidine and 3,5-xylidine.

8. A method according to claim 7, wherein said amine is selected from the group consisting of aliphatic amines having more than 12 and less than 30 carbon atoms.

9. A method according to claim 8, wherein said amine is octadecylamine.

10. A method according to claim 3, wherein at least one of said reaction products is nitrobenzoctadecylamide.

11. A method according to claim 2 or 10, wherein said nitro-benzoctadecylamine is meta-nitrobenzooctadecylamine.

12. A fuel composition for internal combustion engines, comprising:

(a) a major portion of fuel comprising from about 1 to 100% by volume of an alcohol having 1 to 4 carbon atoms and from about 99 to 0% by volume of a non-alcohol fuel selected from the group consisting of (i) compositions comprising one or more individual hydrocarbon components of gasoline and (ii) dimethoxymethane; and (b) a minor portion of a fuel additive comprising a reaction product of a nitro-substituted aromatic carboxylic acid or acid chloride and an amine selected from the group consisting of aliphatic amines, cycloaliphatic amines, and aromatic amines, said reaction product being formed by reacting said carboxylic acid or acid chloride and said amine at a temperature in the range of about 15°-100° C. in a molar ratio in the range of about 1.05/1.10 to about 1.30/1.0 carboxylic acid or acid chloride to amine.

13. A fuel composition according to claim 12, wherein said alcohol is selected from the group consisting of methanol and ethanol.

14. A fuel composition according to claim 13, wherein said alcohol is methanol.

15. A fuel composition according to claim 12, wherein said major portion of fuel comprises from about 1 to 100% by volume of two or more alcohols having 1 to 4 carbon atoms.

16. A fuel composition according to claim 15, wherein said alcohols are methanol and ethanol.

17. A fuel composition according to claim 12, wherein said non-alcohol fuel is gasoline.

18. A fuel composition according to claim 12, wherein said alcohol is methanol and said non-alcohol fuel is gasoline.

19. A fuel composition according to claim 12, wherein said alcohol of (a) is present in an amount of from about 1 to 50% by volume and said non-alcohol fuel of (a) is present in an amount of from about 99 to 50% by volume.

20. A fuel composition according to claim 19, wherein said alcohol of (a) is present in an amount of about 3 to 20% by volume and said non-alcohol fuel of (a) is present in an amount of about 97 to 80% by volume.

21. A fuel composition according to claim 12, wherein said additive is present in an amount of about 0.1 to 5.0% by weight.

22. A fuel composition according to claim 21, wherein said additive is present in an amount of about 0.1 to 1.0% by weight.

23. A fuel composition according to claim 22, wheren said additive is present in an amount of about 0.15% by weight.

24. A fuel composition according to claim 12, wherein said nitro-substituted aromatic carboxylic acid or acid chloride is selected from the group consisting of ortho-nitrobenzoic acid or acid chloride, meta-nitrobenzoic acid or acid chloride, para-nitrobenzoic acid or acid chloride, ortho-para-dinitrophenyl acetic acid or acid chloride, and 3,5,6-trinitrosalicylic or acid chloride.

25. A fuel composition according to claim 24, wherein said nitro-substituted aromatic carboxylic acid or acid chloride is selected from ortho-nitrobenzoic acid or acid chloride, meta-nitrobenzoic acid or acid chloride, and para-nitrobenzoic acid or acid chloride.

26. A fuel composition according to claim 25, wherein said nitro-substituted aromatic carboxylic acid or acid chloride is meta-nitrobenzoic acid or acid chloride.

27. A fuel composition according to claim 12, wherein said amine is selected from the group consisting of aliphatic amines having 10 to 30 carbon atoms, cyclohexylamine, methylcyclohexylamine, aniline, o-toluidine, m-toluidine, p-toluidine, 2,4-xylidine, 2,5-xylidine, 2,6-xylidine, 3,4-xylidine and 3,5-xylidine.

28. A fuel composition according to claim 27, wherein said amine is selected from the group consisting of aliphatic amines having more than 12 and less than 30 carbon atoms.

29. A fuel composition according to claim 28, wherein said amine is octadecylamine.

30. A fuel composition according to claim 12, wherein said reaction product is nitro-benzoctadecylamide.

31. A fuel composition according to claim 12, wherein said reaction product is meta-nitrobenzoctadecylamide.

32. A fuel composition according to claim 12, wherein said fuel additive comprises two or more reaction products obtained from a reaction of a nitro-substituted aromatic carboxylic acid or acid chloride and an amine selected from the group consisting of aliphatic amines, cycloaliphatic amines, and aromatic amines.

33. A fuel additive for use in alcohol and alcohol-containing fuels for inhibiting corrosion and elastomer swelling and degradation caused by alcohol and alcohol-containing fuels, and for increasing lubricity of alcohol and alcohol-containing fuels, comprising a reaction product of a nitro-substituted aromatic carboxylic acid or acid chloride and an amine selected from the group consisting of aliphatic amines, cycloaliphatic amines, and aromatic amines, said reaction product being formed by reacting said carboxylic acid or acid chloride and said amine at a temperature in the range of about 15°–100° C. in a molar ratio in the range of about 1.05/1.10 to about 1.30/1.0 carboxylic acid or acid chloride to amine.

* * * * *

UNITED STATES PATENT AND TRADEMARK OFFICE

CERTIFICATE OF CORRECTION

PATENT NO. : 4,668,245

DATED : May 26, 1987

INVENTOR(S) : Leroy Schieler

It is certified that error appears in the above-identified patent and that said Letters Patent is hereby corrected as shown below:

On the title page insert item [63] to read as follows:

Related U.S. Application Data

--This is a continuation of application Serial No. 605,882 filed May 1, 1984.--

In column 1, line 3 insert the following:

--This is a continuation of application Serial No. 605,882 filed May 1, 1984.--

Signed and Sealed this

Fifteenth Day of November, 1988

*Attest:*

*Attesting Officer*

DONALD J. QUIGG

*Commissioner of Patents and Trademarks*